US005105710A

United States Patent [19]

Rothmel

[11] Patent Number: 5,105,710

[45] Date of Patent: Apr. 21, 1992

[54] TUNED ELECTRONIC DRUM PAD

[76] Inventor: Steven Rothmel, 272 Main St., No. 5-B, Acton, Mass. 01720

[21] Appl. No.: 760,577

[22] Filed: Sep. 16, 1991

[51] Int. Cl.[5] ..... G10D 13/02

[52] U.S. Cl. ..... 84/730; 84/DIG. 12

[58] Field of Search ..... 84/725, 730, 733, 734, 84/743, DIG. 12, DIG. 24

[56] References Cited

U.S. PATENT DOCUMENTS

| | | | |
|---|---|---|---|
| 3,509,264 | 4/1970 | Green | 84/411 R |
| 3,956,959 | 5/1976 | Ebihara et al. | 84/725 |
| 4,279,188 | 7/1981 | Scott | 84/723 |
| 4,479,412 | 10/1984 | Klynas | 84/730 |
| 4,570,522 | 2/1986 | May | 84/DIG. 12 |
| 4,581,972 | 4/1986 | Hoshino | 84/411 P |
| 4,581,973 | 4/1986 | Hoshino | 84/411 P |
| 4,679,479 | 7/1987 | Koyamoto | 84/DIG. 24 |
| 4,947,725 | 8/1990 | Nomura | 84/723 |
| 5,010,803 | 4/1991 | Donnell | 84/743 |
| 5,042,356 | 8/1991 | Karch | 84/725 |

OTHER PUBLICATIONS

Modern Drummer, Sep., 1991, vol. 15, No. 9, pp. 46–47.

*Primary Examiner*—William M. Shoop, Jr.
*Assistant Examiner*—Brian Sircus
*Attorney, Agent, or Firm*—John P. McGonagle

[57] ABSTRACT

A floating metallic striker plate with a transducer positioned by selective antinode alignment at the resonance point of the striker plate, i.e., the point of greatest vibration. A thin disk made from a plastic laminate or wood veneer is positioned at the bottom of a metallic shell and held in place by a locking rim. A metallic bottom plate is placed on top of and attached to the disk. An isolation ring and isolation foam disk are attached to the bottom plate. The metallic striker plate is attached to the isolation ring and interior surface of the shell by silicon adhesive. A flat transducer with electrical connections to a jack in the side of the shell is attached to the striker plate undersurface at the plate's resonance point. A pure gum rubber disk is attached to the striker surface of the striker plate.

20 Claims, 5 Drawing Sheets

TUNED ELECTRONIC DRUM PAD

BACKGROUND OF THE INVENTION

This invention relates to musical instruments, and more particularly to drum pads in which the sound is picked up by a transducer mounted in the pad itself.

It is known to obtain a signal from the beating of a drum by positioning a pick-up such as a speaker cone or transducer-type device within a drum chamber. The signal can then be amplified or processed to obtain the desired sound result. Numerous variations of this basic arrangement have been proposed including the location of the pick-up device on or below the drum head itself.

Notwithstanding the many drum arrangements in the prior art, there still exists a problem with prior art electric drum devices primarily due to their inability to adequately discriminate between sounds desired to be signal generating and other sounds not so wanted. The ability to discriminate is commonly termed the "hotness" of the signal. The "hotter" the signal, the better the signal spike, i.e., narrow bandwidth and amplitude height, resulting from a drum stick strike on the drum pad. A narrower and higher amplitude signal spike is a "hotter" signal and provides improved discrimination between desired signals and spurious sounds.

SUMMARY OF THE INVENTION

In view of the foregoing disadvantages inherent in the known types of devices now present in the prior art, the present invention provides an improved electronic drum pad. As such, the general purpose of the present invention, which will be described subsequently in greater detail, is to provide a new and improved drum pad which has a hotter signal then those known in the prior art.

To attain this, the present invention provides a floating metallic striker plate with a transducer positioned by selective antinode alignment. Selective antinode alignment is defined as placement of the transducer at the resonance point of the striker plate, i.e., the point of greatest vibration. Nodes are those points on a plate which have little or no vibration and antinodes are those points with have the highest levels of vibration. Selective antinode alignment permits the drum maker to tune a drum pad and thereby pick up the signal from a drumstick strike at the plate's point of highest vibration. The positioning of the transducer at the plate's greatest antinode position provides uniformity of response across the pad and maximum velocity sensitivity, i.e., the ability to smoothly and accurately reproduce all dynamic levels.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
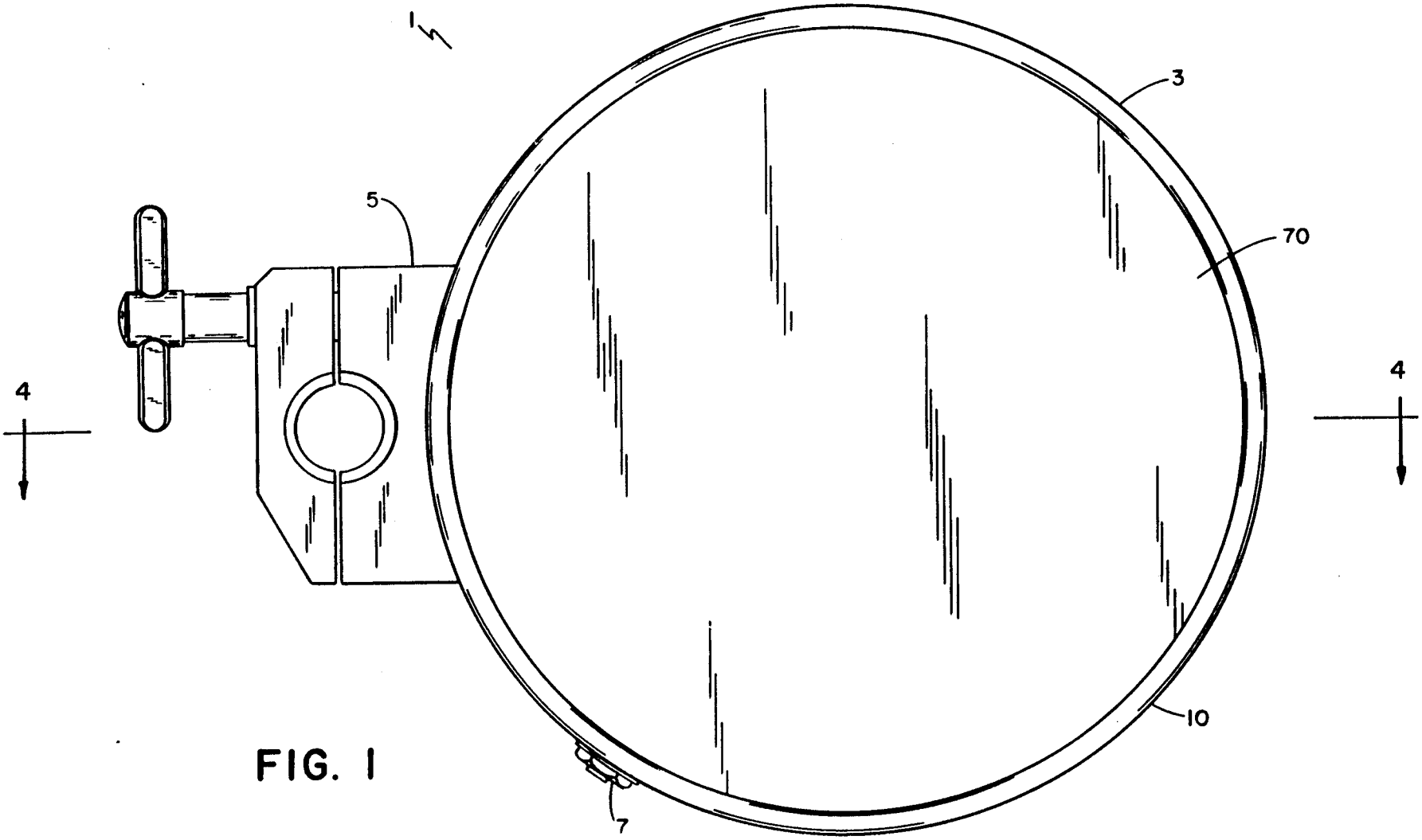
FIG. 1 is a top view of a drum pad in accordance with the present invention.
Figure 2:
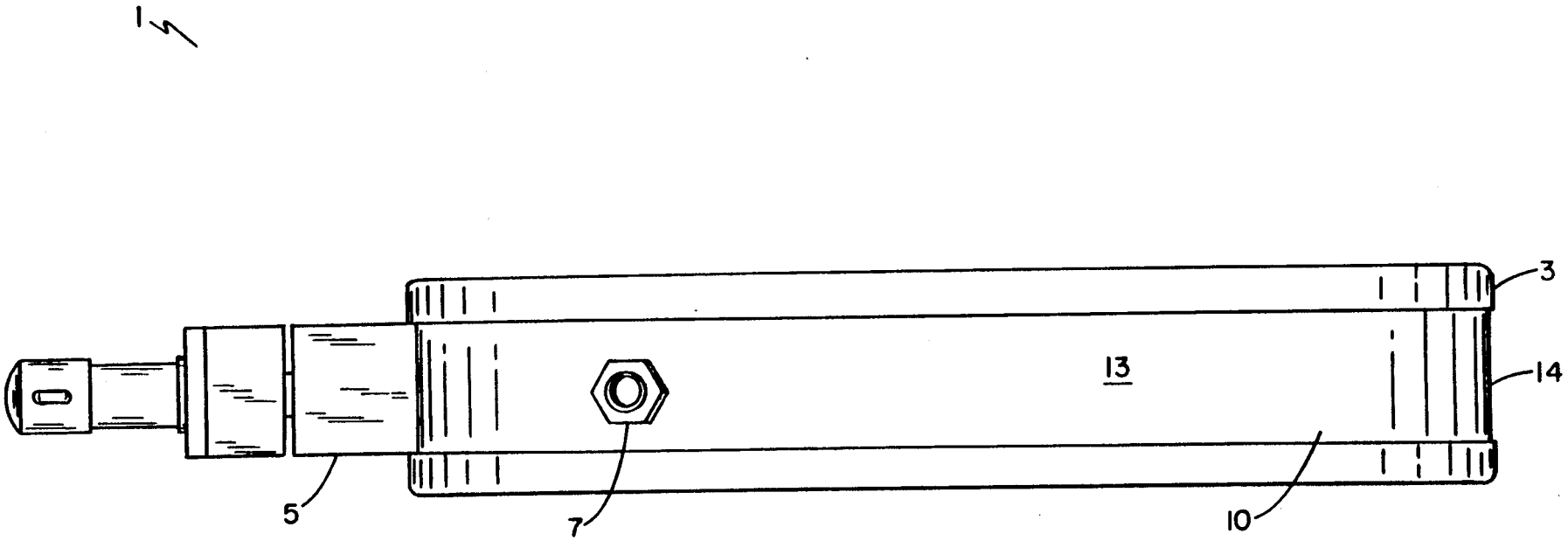
FIG. 2 is a side view of the drum pad of FIG. 1.
Figure 3:
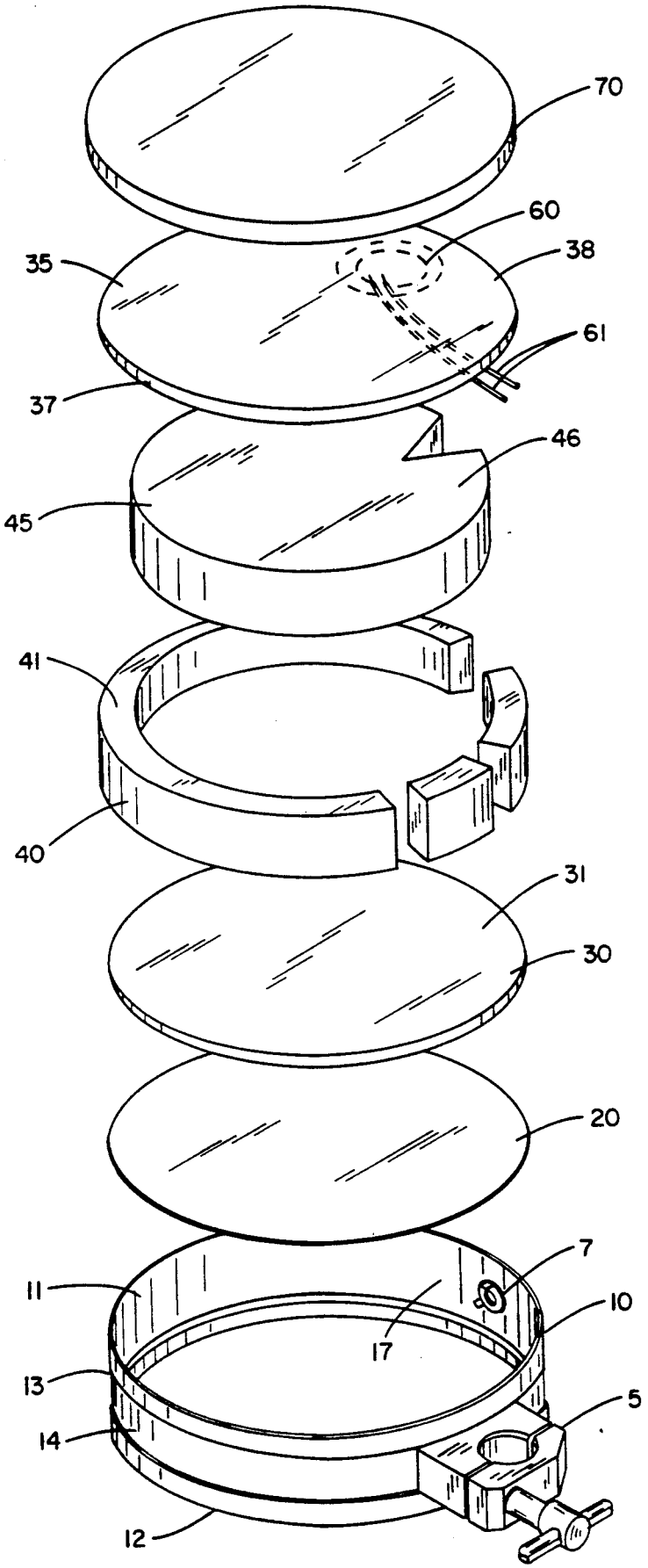
FIG. 3 is an exploded perspective view of the drum pad of FIG. 1.
Figure 4:
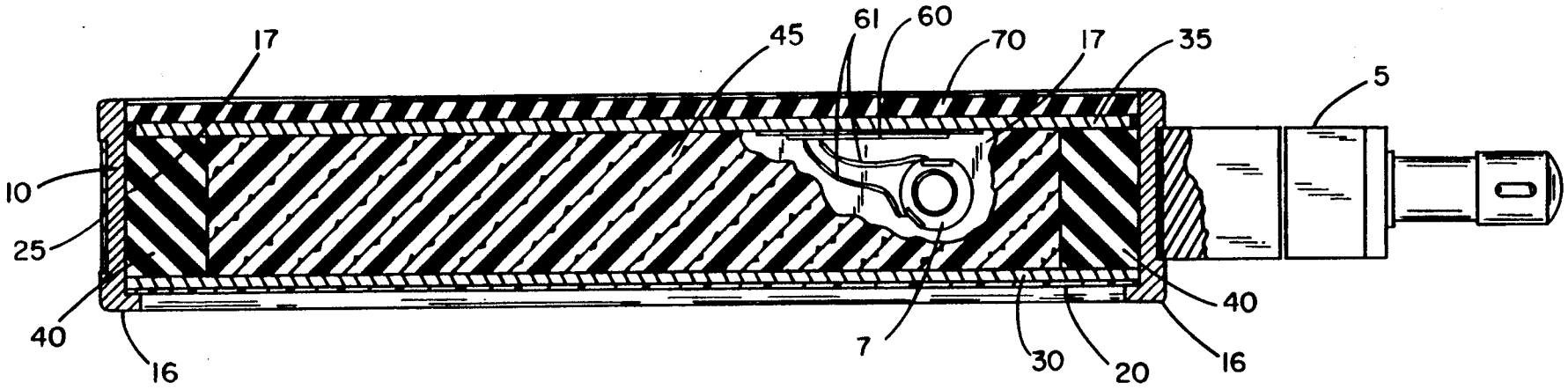
FIG. 4 is a sectional view along the line 4—4 of FIG. 1.
Figure 5:
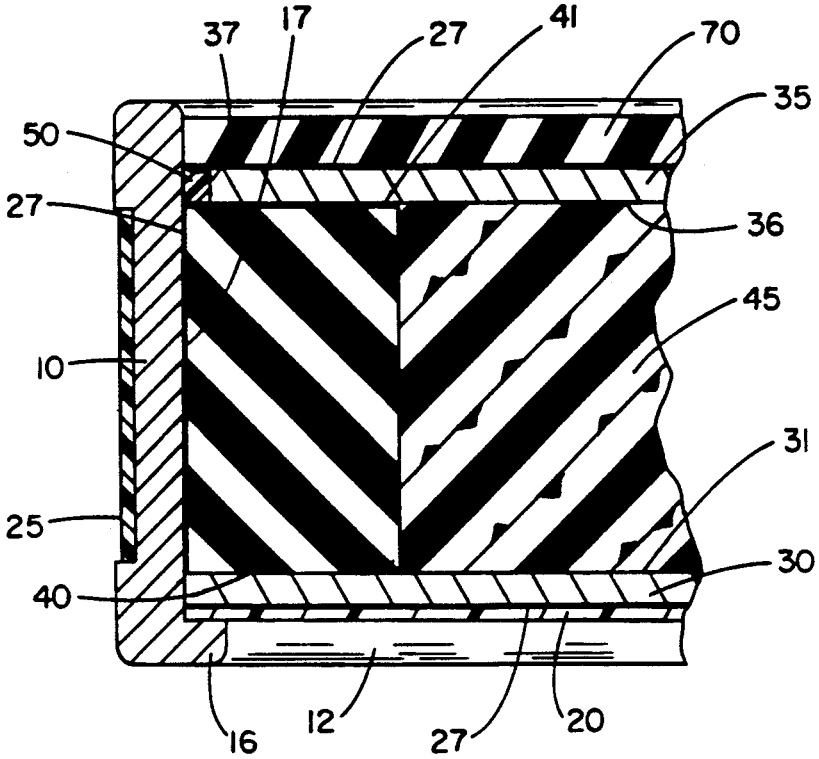
FIG. 5 is an expanded view of a portion of FIG. 4.

Referring to the drawings in detail wherein like elements are indicated by like numerals, there is shown an embodiment of the invention 1 constructed according to the principles of the present invention. There is shown in FIGS. 1 through 5 a circular drum pad 3 with a stand mount 5 radially attached thereto. The drum pad 3 has a shallow, generally cylindrical, black anodized aluminum shell 10 having an open top end 11 and an open bottom end 12. The shell's external radial surface 13 has a pronounced, rectangularly shaped trough 14 formed therein. The bottom of the shell terminates in an inwardly positioned radial flange thereby forming a locking rim 16. A strip 25 made of plastic laminate or wood veneer is fitted into the trough 14 and encircles the shell 10. The strip 25 is locked and held in place by the stand mount 5 and jack 7 described below.

The stand mount 5, also made of machined anodized aluminum alloy, is radially attached to the external shell surface 13. A standard phono jack 7 is externally located on the shell external surface 13 and pierces through to the shell's interior surface 17.

A one-sixteenth inch thick circular disk 20 made from a plastic laminate or wood veneer and having a radial diameter approximately equal to the inner diameter of the shell 10 is fitted into the shell bottom end 12 and held in place by the lower drum rim 16. A circular, aluminum alloy bottom plate 30 with a diameter approximately equal to the inner diameter of the shell 10 is placed on and attached to the disk 20 by means of high shear, rubber adhesive tape 27. The disk 20 and bottom plate 30 combination provides structural support for the drum pad 3, makes it more rugged and provides a firm base. Wood could be used in place of aluminum for the bottom plate, however wood would be more susceptible to humidity changes and damage. In this embodiment of the invention, the bottom plate 30 has a thickness in the 0.06 to 0.065 inch range.

An isolation cylindrical ring 40 having a radial thickness of approximately 0.75 inches and an external diameter approximately equal to the inner diameter of the shell 10 is formed about the inner shell surface wall 17. The isolation ring 40 rests on the bottom plate upper surface 31 and is attached to the shell interior surface 17 by means of high sheer, rubber adhesive tape 27. The isolation ring 40 in this embodiment of the invention is made of a closed cell foam such as neoprene medium closed cell sponge rubber. The isolation ring 40 has gaps for the jack 7 and bolts (not shown) fastening the stand mount 5 to the shell 10.

An isolation foam disk 45 with a diameter approximately equal to the inner diameter of the isolation ring 40 is fitted within the isolation ring 40 and rests on the bottom plate upper surface 31. The isolation foam 45 in this embodiment of the invention is made of an open cell foam such as polyester urathene. The foam disk 45 has a small wedge removed to allow space for the jack 7. In an alternate embodiment, the isolation ring 40 and isolation foam 45 could be replaced with a closed cell foam rubber disk.

A circular metallic top plate 35 with a diameter less than the internal diameter of the drum shell 10 is placed on and attached to the isolation ring upper surface 41. The top plate 35 is 0.09 inches thick and is made out of an aluminum alloy. In this embodiment of the invention the aluminum alloy is comprised of 0.6% silicon, 0.28% copper, 1.0% magnesium, 0.2% chromium, and 97.92% aluminum. A pure gum rubber disk 70 with a diameter approximately equal to the inner diameter of the shell 10 is attached by means of high shear, rubber adhesive tape 27 to the top plate upper surface 38. The gum rubber disk 70 provides a better "feel" to the drum pad 3.

Before the plate 35 is actually attached to the isolation ring 40 it is "tuned". A flat piezo transducer 60 is placed on the isolation foam upper surface 46. The plate is then placed onto the ring 40 and the top plate's under surface 36 comes in contact with the transducer 60. The transducer 60 is electrically connected to the phono jack 7 by two signal wires 61. An oscilloscope (not shown) for node and anti-node measurements is then electrically connected to the phono jack 7. The inventor has found that every plate 35 is different with respect to resonance patterns. The transducer 60 position is varied about the plate undersurface 36 to determine the resonance point, i.e., anti-node, where vibration from the plate 35 is greatest when struck. By this method, the most uniform series of electronic spikes, i.e., triggers, will be obtained from strikes on various points across the plate. The invention takes advantage of the highest antinode spot on the aluminum plate 35 by placing the "trigger" (transducer) there. As a result, when the plate 35 is struck, the transducer will see a high deflection. When the best resonance point of the plate 35 has been determined, the transducer 60 is attached at that point (best resonance point) to the plate undersurface 36 with silicon adhesive.

A silicon adhesive bead 50 is placed on the isolation ring upper surface 41. The silicon bead 50 locks the plate to the isolation ring 40. As the plate 35 is placed onto the ring 40, the pressure from the plate 35 forces silicon 50 up and around the metal plate radial side 37 thereby tieing the plate 35 to the shell interior surface 17. The silicon adhesive 50 has elasticity. The elasticity provides isolation between the top plate 35 and the invention structure. Consequently, the plate 35 can be deemed to be "floating" within the drum pad 3 interior. This insures that when plate 35 resonance is determined, there will not be a change due to drum pad structure resonance. This results in an even response across the entire pad 3, a hot signal, and elimination of false triggers.

It is understood that the above-described embodiment is merely illustrative of the application. Other embodiments may be readily devised by those skilled in the art which will embody the principles of the invention and fall within the spirit and scope thereof.

I claim:

1. A tuned electronic drum pad comprising:

a shallow, generally cylindrical shell having an external radial surface, an internal radial surface, an open top end and an open bottom end;

a stand mount radially attached to said shell external radial surface;

a phono jack externally located on the shell external surface and piercing through to the shell internal surface;

a circular bottom disk with a diameter approximately equal to the inner diameter of the shell fitted into the shell bottom end and held in place by a lower drum rim;

a circular, metallic bottom plate having upper and bottom surfaces and diameter approximately equal to the inner diameter of the shell placed on and attached to the bottom disk;

an isolation cylindrical ring, having an upper and a lower surface and an external diameter approximately equal to the inner diameter of the shell and placed within the inner shell surface, said ring resting on and attached to the bottom plate upper surface;

an isolation foam disk with a diameter approximately equal to an inner diameter of the isolation ring fitted within the isolation ring and attached to the bottom plate upper surface;

a metallic, circular top plate having upper and bottom surfaces and a diameter approximately equal to the internal diameter of the drum shell said top plate having a resonance point at which vibration of the plate is greatest when the plate is struck, placed on and resiliently attached to the isolation ring upper surface and shell internal radial surface;

a gum rubber disk with a diameter approximately equal to the inner diameter of the shell attached to the top plate upper surface;

a flat transducer, electrically connected to said phono jack, affixed to the top plate undersurface at the top plate resonance point.

2. A tuned electronic drum pad according to claim 1, wherein:

the shell's external radial surface has a rectangularly shaped trough formed therein.

3. A tuned electronic drum pad according to claim 2, wherein:

the bottom of the shell terminates in an inwardly positioned radial flange thereby forming a locking rim.

4. A tuned electronic drum pad according to claim 3, further comprising:

an encircling strip made from a plastic laminate or wood veneer is fitted into and attached within the shell trough.

5. A tuned electronic drum pad according to claim 4, wherein:

said bottom plate is attached to said bottom disk by means of high shear, rubber adhesive tape.

6. A tuned electronic drum pad according to claim 5, wherein:

said shell and said bottom plate are made from an aluminum alloy.

7. A tuned electronic drum pad according to claim 6, wherein:

said bottom disk is made from a plastic laminate or wood veneer.

8. A tuned electronic drum pad according to claim 7, wherein:

said isolation ring has a radial thickness of approximately 0.75 inches.

9. A tuned electronic drum pad according to claim 8, wherein:

said isolation ring is attached to said bottom plate upper surface by high shear, rubber adhesive tape.

10. A tuned electronic drum pad according to claim 9, wherein:

said isolation ring is made of a closed cell foam.

11. A tuned electronic drum pad according to claim 10, wherein:

said closed cell foam is neoprene medium closed cell sponge rubber.

12. A tuned electronic drum pad according to claim 11, wherein:

said isolation foam rests on said bottom plate.

13. A tuned electronic drum pad according to claim 12, wherein:

said isolation foam in this embodiment of the invention is made of an open cell foam.

14. A tuned electronic drum pad according to claim 13, wherein:

said open cell foam is polyester urathene.

15. A tuned electronic drum pad according to claim 14, wherein:

said top plate is made out of an aluminum alloy.

16. A tuned electronic drum pad according to claim 15, wherein:

said gum rubber is attached to the top plate by means of high shear, rubber adhesive tape.

17. A tuned electronic drum pad comprising:

a shallow, generally cylindrical shell having an external radial surface, an internal radial surface, an open top end and an open bottom end;

a stand mount radially attached to said shell external radial surface;

a phono jack located on the shell external surface and piercing through to the shell internal surface;

a circular bottom disk with a diameter approximately equal to the inner diameter of the shell fitted into the shell bottom end and held in place by a lower drum rim;

a circular, metallic bottom plate having upper and bottom surfaces and diameter approximately equal to the inner diameter of the shell placed on and attached to the bottom disk;

an isolation disk having upper and bottom surfaces and an external diameter approximately equal to the inner diameter of the shell, said isolation disk resting on and attached to the bottom plate upper surface;

a metallic, circular top plate having upper and bottom surfaces and a diameter approximately equal to the internal diameter of the drum shell said top plate having a resonance point at which vibration of the plate is greatest when the plate is struck, placed on and resiliently attached to the isolation disk upper surface and shell internal radial surface;

a gum rubber disk with a diameter approximately equal to the inner diameter of the shell attached to the top plate upper surface; and a flat transducer electrically connected to said phono jack affixed to the top plate undersurface at the top plate resonance point.

18. A tuned electronic drum pad according to claim 17, wherein:

said isolation disk is made of a closed cell foam.

19. A tuned electronic drum pad according to claim 18, wherein:

said closed cell foam is neoprene medium closed cell sponge rubber.

20. A tuned electronic drum pad according to claim 19, wherein:

said shell, bottom plate and top plate are made from an aluminum alloy.

* * * * *